US005857594A

United States Patent [19]

Ozturk

[11] Patent Number: 5,857,594

[45] Date of Patent: Jan. 12, 1999

[54] LIQUID SOAP FAUCET DISPENSER

[76] Inventor: Ahmet Ozturk, 7593 La Corniche Cir., Boca Raton, Fla. 33433

[21] Appl. No.: 956,845

[22] Filed: Oct. 23, 1997

[51] Int. Cl.[6] ..... E03C 1/05

[52] U.S. Cl. ..... 222/185.1; 222/192; 4/675

[58] Field of Search ..... 222/185.1, 192; 239/310; 4/675

[56] References Cited

U.S. PATENT DOCUMENTS

| | | | |
|---|---|---|---|
| D. 366,834 | 2/1996 | Reid | D9/447 |
| 3,990,611 | 11/1976 | Sojka | 222/135 |
| 4,397,050 | 8/1983 | Davis | 4/601 |
| 4,625,896 | 12/1986 | Rocchelli | 222/180 |
| 5,031,258 | 7/1991 | Shaw | 4/623 |
| 5,114,048 | 5/1992 | Minke | 222/135 |
| 5,625,908 | 5/1997 | Shaw | 4/623 |

*Primary Examiner*—Steven O. Douglas

[57] ABSTRACT

A device which is attached to the end of a standard kitchen faucet and dispenses liquid soap on to an object to be washed. When dispensing soap the device cuts off the flow of water to permit the user and opportunity to wash the object and conserve water. The device is activated by rotating the device in a first direction which cuts off the flow of water and dispensed liquid soap. When the device is returned to the original position the water flow is restored and the dispensing of liquid soap is stopped.

6 Claims, 2 Drawing Sheets

LIQUID SOAP FAUCET DISPENSER

BACKGROUND OF THE INVENTION

1. Field of the Invention

The present invention relates to dispensing devices. More particularly, the present invention relates to a soap dispensing device which is attached to a common kitchen faucet.

2. Description of the Prior Art

Generally, liquid soap dispensers a re remote or attached to the perimeter of a sink. The liquid soap dispensers function a user pushing a pump device or picking up the dispenser turning it over and squeezing it to eject liquid soap from a nozzle. These have significant disadvantages including wasting water while the user applies soap to an object while leaving the water running. Further, the perimeter mounted dispensers limit the location on the object the soap can be place because of the typically short length of the dispenser spout. What is desired is a liquid soap dispenser that attaches to the faucet of a standard kitchen faucet and cuts off the flow of water when the soap is dispensed.

Numerous innovations for liquid soap faucet dispenser have been provided in the prior art that are described as follows. Even though these innovations may be suitable for the specific individual purposes to which they address, they differ from the present invention as hereinafter contrasted.

In U.S. Pat. No. 5,625,908, titled Wash Station and Method of Operation, Daniel Shaw a wash station comprises a sink and a faucet. A source of water and a source of soap are provided. An electrically operated valve is interposed between the water source and the faucet for selectively supplying water thereto, and a pump and valve are interposed between the soap source and the faucet for selectively supplying soap thereto. An electrically operated roll towel dispenser is disposed proximate the sink. A first infrared sensor is operably associated with the sink for determining the presence of a user. A control mechanism is operatively associated with the valves, the pump, the roll towel dispenser and the sensor for causing water and soap to be selectively supplied to the faucet and for thereafter causing a length of roll towel to be dispensed.

The patented invention differs from the present invention because the patented invention is a wash station consisting of a sink and a faucet. Soap is contained in an under the sink reservoir, a pump moves the soap from the reservoir to a dispenser. The present invention is a soap dispensing device which attaches to a faucet. The patented invention lacks features similar to the present invention.

In Patent number D366,834, titled Dispenser Spout, invented by Mary J. Reid, an ornamental design for a dispenser spout, as shown and described.

The patented invention differs from the present invention because the patented invention is an ornamental design for a dispenser spout. The patented invention lacks features similar to the present invention.

In U.S. Pat. No. 5,114,048, titled Faucet Assembly Having Integral Liquid Product Dispenser, invented by Robert M. Minke, a faucet assembly having an integral dispenser for supplying liquid products, such as soap, lotion, and the like, adjacent to the flow of water therefrom is disclosed. The faucet assembly includes a housing having a conventional mixer tap mounted therein for supplying water from a spigot. A pair of upstanding liquid dispenser housings are formed integrally with or secured to the faucet assembly housing. Within each of these dispenser housing, a manually operable pump assembly is disposed. The pump assemblies are manually operable to pump liquid products from respective liquid reservoirs to a dispenser block located within the faucet assembly adjacent to the spigot thereof The dispenser block discharges the liquid products adjacent to the flow of water from the faucet assembly. The dispenser block may be formed integrally with the faucet housing or as a separate piece releasably secured thereto.

The patented invention differs from the present invention because the patented invention is a faucet assembly having an integral soap dispenser. The present invention is a soap dispensing device which attaches to a faucet.

In U.S. Pat. No. 5,031,258, titled Wash Station and Method of Operation, Daniel Shaw, a wash station comprises a sink and a faucet. A source of water and a source of soap are provided. An electrically operated valve is interposed between the water source and the faucet for selectively supplying water thereto, and a pump and valve are interposed between the soap source and the faucet for selectively supplying soap thereto. An electrically operated roll towel dispenser is disposed proximate the sink. A first infrared sensor is operably associated with the sink for determining the presence of a user. A control mechanism is operatively associated with the valves, the pump, the roll towel dispenser and the sensor for causing water and soap to be selectively supplied to the faucet and for thereafter causing a length of roll towel to be dispensed.

The patented invention differs from the present invention because the patented invention is a wash station consisting of a sink and a faucet. Soap is contained in an under the sink reservoir, a pump moves the soap from the reservoir to a dispenser. The present invention is a soap dispensing device which attaches to a faucet. The patented invention lacks features similar to the present invention.

In U.S. Pat. No. 4,625,896, titled Device for Dispensing Liquid Soap, invented by Gianpaolo Rocchelli, a device which is affixable to an unit such as a mixer tap or a tap outlet which delivers water to wash basins or sinks, and comprises at least one delivery outlet for liquid soap. The outlet has affixed thereto, or integrally formed therewith a substantially part-annular collar which is insertable between the base of the body of the unit which delivers water and the plane on or against which the unit is fixed. The collar is secured in such location by a threaded connection utilized for fixing the unit to the plane.

The patented invention differs from the present invention because the patented invention is a device which attached to a mixer tap having a delivery outlet for liquid soap. The soap dispenser of the patented invention is built into the faucet and cannot be retrofit to existing faucets without substantial modification. The present invention is a soap dispensing device which attaches to a faucet. The present invention has a soap reservoir with a filler cap, attached to a metering device that controls the flow of soap and the water stream. An adapter permits attachment of the present invention to the faucet. Rotating the invention from vertical causes the water flow to stop and soap to be dispensed.

In U.S. Pat. No. 4,397,050, titled Quick Shower or Power Shower, invented by Clifford E. S. Davis a shower device attachable by suction cups to a wall, such as adjacent a bath tub; the device including a panel supporting a row of adjustable shower heads to each of which water is supplied that is selectively mixed with diluted soap from a soap dispenser mounted on the panel, a pulsator being selectively used to pulsate the sprayed water, and a flexible hose from the device for connection to a water supply faucet valve.

The patented invention differs from the present invention because the patented invention is a shower device attachable by suction cups to a wall. The patented invention lacks features similar to the present invention.

In U.S. Pat. No. 3,990,611, titled Plural Metering Dispensers with Wall Securing Rack, invented by James Andrew Sojka, a metering and dispensing apparatus is disclosed for metering and dispensing liquid bath products such as shampoo and the like comprising a plurality of dispensers of the pump type secured to a rack member wherein the rack member has a securing device affixed thereto by which the rack member and dispensing apparatus may be readily affixed to a bathroom wall.

The patented invention differs from the present invention because the patented invention is a metering and dispensing apparatus. The patented invention lacks an attachment means to a faucet end. The present invention is a soap dispensing device which attaches to a faucet. The present invention has a soap reservoir with a filler cap, attached to a metering device that controls the flow of soap and the water stream.

Numerous innovations for a liquid soap faucet dispenser have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a device which is attached to the end of a standard kitchen faucet and dispenses liquid soap on to an object to be washed. When dispensing soap the present invention cuts off the flow of water to permit the user and opportunity to wash the object and conserve water. The present invention is activated by rotating the device in a first direction which cuts off the flow of water and dispensed liquid soap. When the present invention is returned to the original position the water flow is restored and the dispensing of liquid soap is stopped.

The types of problems encountered in the prior art are a need to dispense liquid soap on to an object which is being washed in a kitchen sink.

In the prior art, unsuccessful attempts to solve this problem were attempted namely dispensers mounted around the perimeter of a sink or specially adapted faucets having a dispensing mechanism built in. Additionally, complex mechanisms were proposed which would be very costly to install. However, the problem was solved by the present invention because the present invention installs onto the end of the faucet with out further modification. The present invention operates with simple rotation of the device to a dispensing position then return to a closed position.

The present invention solved a long felt need for a simple device capable of dispensing soap onto a dish which is being washed in the sink of a kitchen.

Accordingly, it is an object of the present invention to provide a soap dispenser which also control the water flow from a faucet and dispenses soap in the middle of a sink.

More particularly, it is an object of the present invention to provide a water flow control which maintains the water temperature initially set with the hot and cold valves.

In keeping with these objects, and with others which will become apparent hereinafter, one feature of the present invention resides, briefly stated, in a faucet body having a faucet adapter which attaches in a complementary fashion to a faucet end.

In accordance with another feature of the present invention, a faucet water pressure reducer lowers the water pressure going to the faucet adapter.

Another feature of the present invention is that soap is dispensed via gravity feed.

Yet another feature of the present invention is that a soap dispenser adapter soap adjuster controls the amount of soap released through a soap dispenser soap tube.

Still another feature of the present invention is that a soap dispenser outlet which alternatively discharges soap and water downwardly.

Yet still another feature of the present invention is that a soap dispenser reservoir is filled by pouring soap through a soap dispenser reservoir opening. The soap is retained within the reservoir by a soap dispenser reservoir opening cap which closes the soap dispenser reservoir opening.

Still yet another feature of the present invention is that faucet adapter functions to removably attach the liquid soap faucet dispenser to a faucet.

Another feature of the present invention is that faucet adapter has a faucet water pressure reducer which lowers the incoming water pressure before it flows through the soap dispenser outlet.

Yet another feature of the present invention is that a faucet valve, located inside the faucet body causes soap to be dispensed when the soap dispenser is rotated from an initial horizontal position to a vertical position. At the same time water flow is cut off. When the soap dispenser is rotated from the vertical position to the horizontal position soap dispensing stops and the water flow is restarted.

Still another feature of the present invention is that a faucet valve spring is retained on one end by a faucet valve adjustment nut and a faucet valve lock nut this arrangement provides for adjustment of the spring pressure applied to the valve seat.

Yet another feature of the present invention is that hygiene control is improved because soap is readily available and easy to access when a person is washing his hands.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—liquid soap faucet dispenser (10)
12—faucet body (12)
12A—faucet adapter (12A)
12B—faucet water pressure reducer (12B)
12BA—faucet water pressure reducer side opening (12BA)
12BB—faucet water pressure reducer bottom opening (12BB)
12C—faucet connector (12C)
12D—faucet valve (12D)
12DA—faucet valve sleeve (12DA)
12DB—faucet valve cap (12DB)
12DC—faucet valve seat (1 2DC)
12DD—faucet valve retainer (12DD)
12DE—faucet valve rod (12DE)
12DF—faucet valve spring (12DF)
12DGA—faucet valve first washer (12DGA)
12DGB—faucet valve second washer (12DGB)
12DH—faucet valve adjustment nut (12DH)
12DI—faucet valve lock nut (12DI)

12DJ—faucet valve O-ring (12DJ)
14—soap dispenser (14)
14A—soap dispenser adapter (14A)
14AA—soap dispenser adapter soap adjuster (14AA)
14B—soap dispenser soap tube (14B)
14BA—soap dispenser soap tube outlet (14BA)
14C—soap dispenser connector (14C)
14CA—soap dispenser connector slot (14CA)
14D—soap dispenser connector pin (14D)
14E—soap dispenser lock nut (14E)
14F—soap dispenser adjustment nut (14F)
14G—soap dispenser washer (14G)
14H—soap dispenser end sleeve (14H)
14I—soap dispenser outlet (14I)
14J—soap dispenser reservoir (14J)
14JA—soap dispenser reservoir opening (14JA)
14JAA—soap dispenser reservoir opening cap (14JAA)

DESCRIPTION OF THE PREFERRED EMBODIMENT

Figure 1:
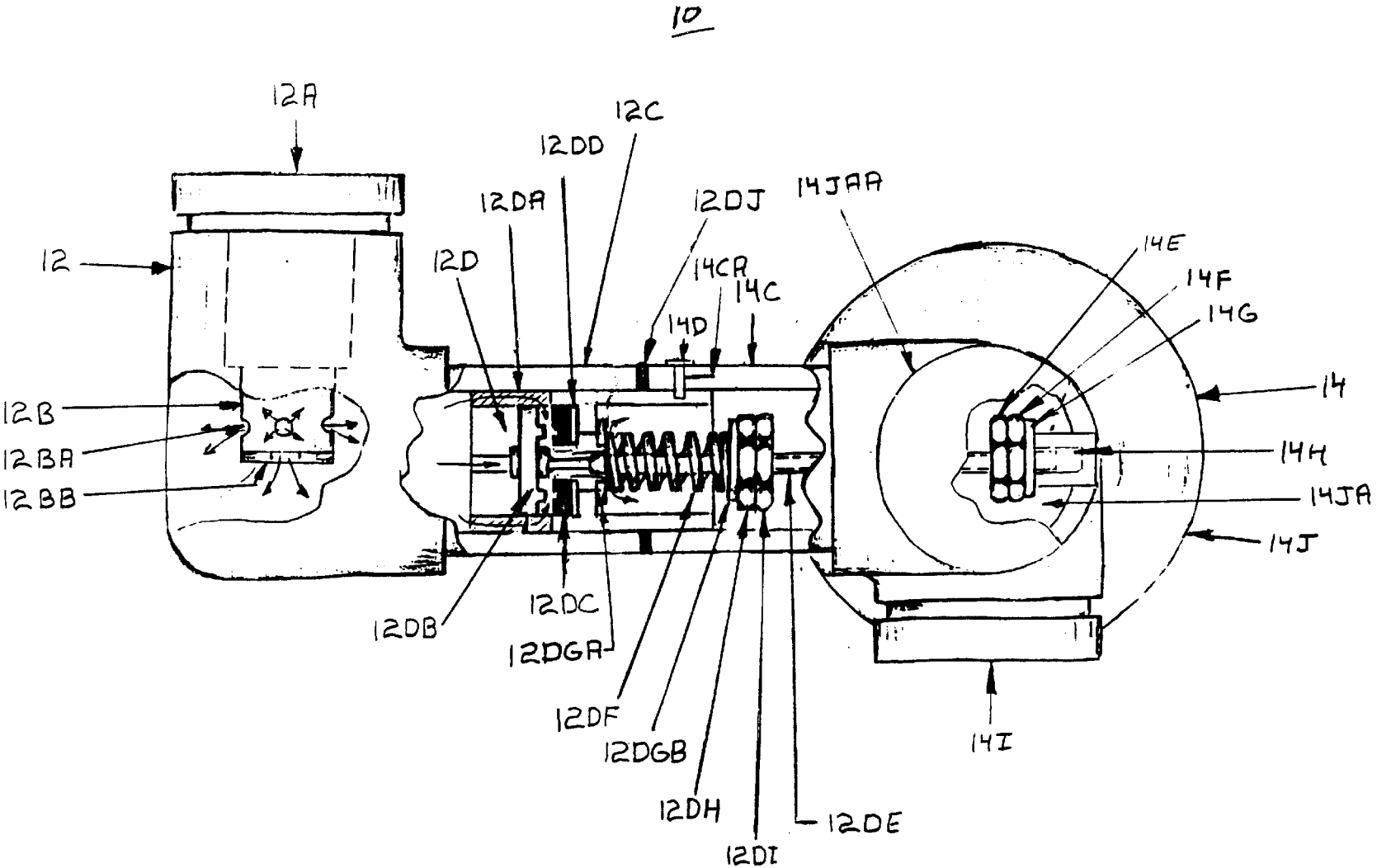
FIG. 1 is a side view of a liquid soap faucet dispenser with a soap dispenser in a horizontal position.

Referring to FIG. 1 which is a side view of a liquid soap faucet dispenser (10) with a soap dispenser (14) in a horizontal position. The liquid soap faucet dispenser (10) comprises a faucet body (12). The faucet body (12) comprises a faucet adapter (12A) positioned at a top distal end of the faucet body (12) and is swively connected, at one distal end, thereto. The opposite distal end of the faucet adapter (12A) is adapted to connect the liquid soap faucet dispenser (10) to a standard sink faucet, which is a water source. The faucet body (12) further comprises a faucet water pressure reducer (12B) sealably connected to the faucet adapter (12A) extending downwardly therefrom within the faucet body (12). The faucet water pressure reducer (12B) further comprises at least one faucet water pressure reducer side opening (12BA) therein. The faucet water pressure reducer (12B) further comprises at least one faucet water pressure reducer bottom opening (12BB) therein. The faucet water pressure reducer (12B) functions to reduce the water pressure flowing from the water source into the faucet body (12).

The faucet body (12) further comprises a faucet connector (12C) extending at a perpendicular angle outwardly therefrom. The faucet body (12) further comprises a faucet valve (12D) positioned within a faucet valve sleeve (12DA) within the faucet connector (12C). The faucet valve (12D) comprises a faucet valve rod (12DE) longitudinally disposed in a central position within the faucet valve sleeve (12DA). The faucet valve (12D) further comprises a faucet valve O-ring (12DJ) circumferentially positioned around the faucet valve sleeve (12DA) between the faucet connector (12C) and the soap dispenser connector (14C). The faucet valve O-ring (12DJ) functions to provide a seal between the faucet connector (12C) and a soap dispenser connector (14C).

A faucet valve cap (12DB) is securely affixed to a first distal end of the faucet valve rod (12DE). A faucet valve seat (12DC) and a faucet valve retainer (12DD) are securely circumferentially positioned within the faucet valve sleeve (12DA). The faucet valve seat (12DC) and the faucet valve retainer (12DD) sealably engages the faucet valve cap (12DB) when in a closed position. A faucet valve first washer (12DGA) is positioned around the faucet valve rod (12DE) adjacent to the faucet valve seat (12DC) and the faucet valve retainer (12DD). A faucet valve spring (12DF) is positioned around the faucet valve rod (12DE) adjacent to the faucet valve first washer (12DGA). A faucet valve second washer (12DGB) is positioned around the faucet valve rod (12DE) adjacent to the faucet valve spring (12DF). A faucet valve adjustment nut (12DH) is treadably engaged on the faucet valve rod (12DE) adjacent to the faucet valve second washer (12DGB). The faucet valve spring (12DF) functions to force the faucet valve seat (12DC) against the faucet valve cap (12DB). The faucet valve adjustment nut (12DH) functions to provide for adjustment of the force the faucet valve seat (12DC) exerts against the faucet valve cap (12DB).

The faucet valve (12D) further comprises a faucet valve lock nut (12DI) which is threadably engaged on the faucet valve rod (12DE) positioned adjacent to the faucet valve adjustment nut (12DH). The faucet valve lock nut (12DI), when tightened against the faucet valve adjustment nut (12DH), functions to prevent the faucet valve adjustment nut (12DH) from rotating away from a preselected position.

The liquid soap faucet dispenser (10) further comprises a soap dispenser (14) which comprises a soap dispenser adapter (14A) positioned at a top distal end. The soap dispenser adapter (14A) comprises a soap dispenser adapter soap adjuster (14AA) functioning to regulate an amount of liquid soap dispensed therefrom, soap dispenser soap tube (14B), having a soap dispenser soap tube outlet (14BA), is sealably connected to the soap dispenser adapter (14A) extending downwardly therefrom through an opening in the soap dispenser (14), a bottom end of a soap dispenser reservoir (14J) is sealably connected to the soap dispenser adapter (14A). The soap dispenser reservoir (14J) comprises a soap dispenser reservoir opening (14JA) at a top end thereof, a soap dispenser reservoir opening cap (14JAA) is removably sealably positioned on the soap dispenser reservoir opening (14JA). The soap dispenser reservoir opening cap (14JAA) comprises a soap dispenser air release valve (14JAAA). The soap dispenser air release valve (14JAAA) functions as a vacuum break. The soap dispenser (14) further comprises a soap dispenser connector (14C) extending perpendicularly therefrom rotatably mounted on the faucet valve sleeve (12DA). The faucet valve rod (12DE) extends longitudinally in a middle of the soap dispenser connector (14C) and terminates in a soap dispenser end sleeve (14H) securely mounted to an inside wall of the soap dispenser (14). The soap dispenser connector (14C) further comprises a slanted soap dispenser connector slot (14CA) therein, a soap dispenser connector in (14D) is securely attached to the faucet valve sleeve (12DA) within the soap dispenser connector slot (14CA), a soap dispenser washer (14G) is positioned around the faucet valve rod (12DE) adjacent to the soap dispenser end sleeve (14H), a soap dispenser lock nut (14E) is threadably mounted on the faucet valve rod (12DE) adjacent to the soap dispenser lock nut (14E). A soap dispenser adjustment nut (14F) is threadably positioned on the faucet valve rod (12DE) adjacent to the soap dispenser lock nut (14E). The soap dispenser adjustment nut (14F) functions when tightened against the soap dispenser lock nut (14E) to prevent the soap dispenser lock nut (14E) from rotating away from a preselected position.

The soap dispenser (14) further comprises a soap dispenser outlet (14I) positioned on a side thereof When a user positions the soap dispenser (14) in a horizontal position, the faucet valve spring (12DF) compresses which causes the faucet valve cap (12DB) to disengage from the faucet valve seat (12DC) allowing water to flow from the faucet through the faucet body (12) and the soap dispenser (14) egressing through the soap dispenser outlet (14I). When the user positions the soap dispenser (14) in a vertical position, the faucet valve spring (12DF) decompresses causing the faucet valve cap (12DB) move toward and engage the faucet valve seat (12DC) which stops the flow of water and allows liquid soap to flow from the soap dispenser reservoir (14J) through the soap dispenser soap tube (14B) egressing from the soap dispenser soap tube outlet (14BA).

Figure 2:
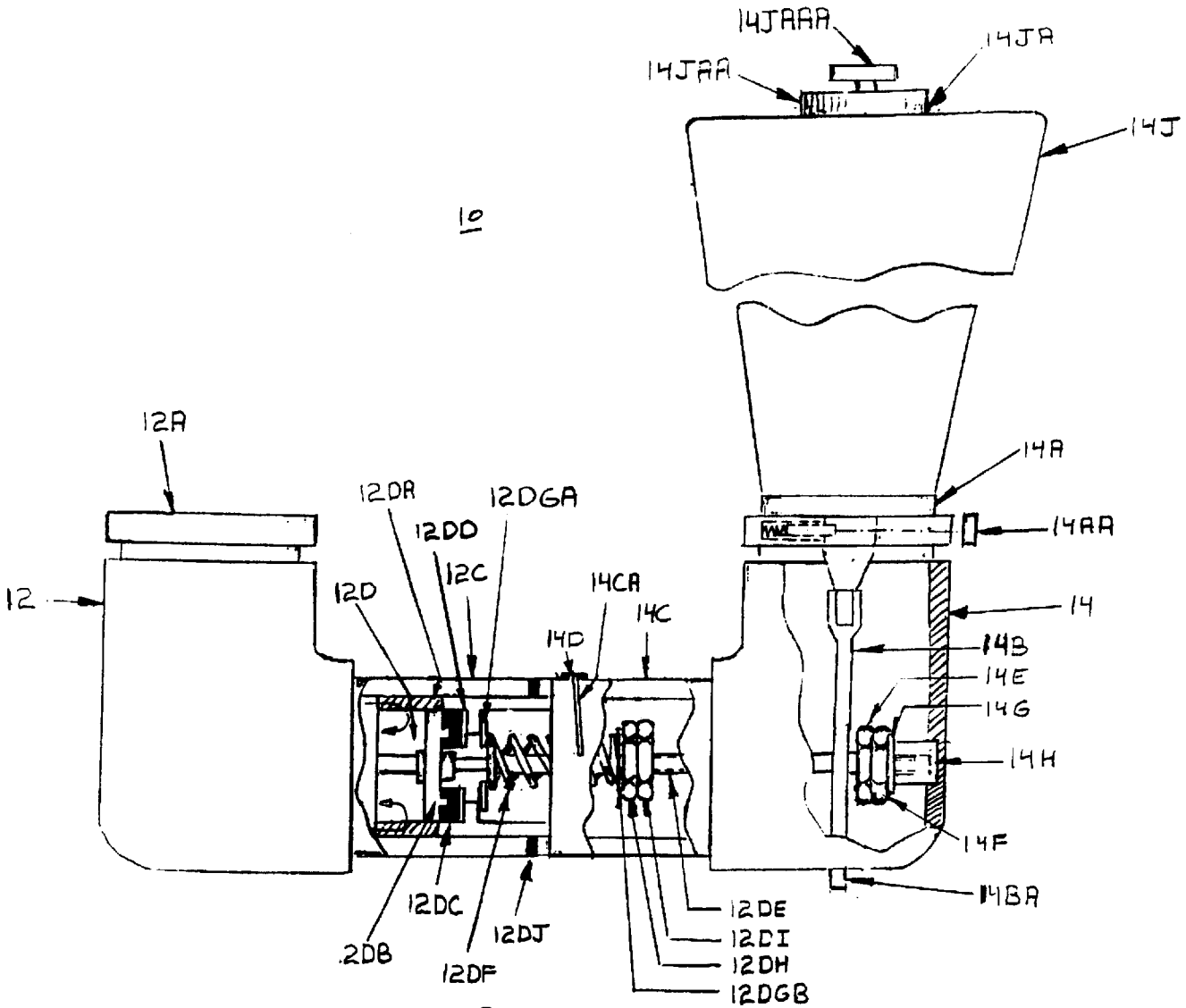
FIG. 2 is a side view of a liquid soap faucet dispenser with a soap dispenser in a vertical position.

Lastly, referring to FIG. 2 which is a side view of the liquid soap faucet dispenser (10) with the soap dispenser (14) in a vertical position. The liquid soap faucet dispenser (10) comprises a faucet body (12). The faucet body (12) comprises a faucet adapter (12A) positioned at a top distal end of the faucet body (12) and is swively connected, at one distal end, thereto. The opposite distal end of the faucet adapter (12A) is adapted to connect the liquid soap faucet dispenser (10) to a standard sink faucet, which is a water source. The faucet body (12) further comprises a faucet water pressure reducer (12B) sealably connected to the faucet adapter (12A) extending downwardly therefrom within the faucet body (12). The faucet water pressure reducer (12B) further comprises at least one faucet water pressure reducer side opening (12BA) therein. The faucet water pressure reducer (12B) further comprises at least one faucet water pressure reducer bottom opening (12BB) therein. The faucet water pressure reducer (12B) functions to reduce the water pressure flowing from the water source into the faucet body (12).

The faucet body (12) further comprises a faucet connector (12C) extending at a perpendicular angle outwardly therefrom. The faucet body (12) further comprises a faucet valve (12D) positioned within a faucet valve sleeve (12DA) within the faucet connector (12C). The faucet valve (12D) comprises a faucet valve rod (12DE) longitudinally disposed in a central position within the faucet valve sleeve (12DA). The faucet valve (12D) further comprises a faucet valve O-ring (12DJ) circumferentially positioned around the faucet valve sleeve (12DA) between the faucet connector (12C) and the soap dispenser connector (14C). The faucet valve O-ring (12DJ) functions to provide a seal between the faucet connector (12C) and a soap dispenser connector (14C).

A faucet valve cap (12DB) is securely affixed to a first distal end of the faucet valve rod (12DE). A faucet valve seat (12DC) and a faucet valve retainer (12DD) are securely circumferentially positioned within the faucet valve sleeve (12DA). The faucet valve seat (12DC) and the faucet valve retainer (12DD) sealably engages the faucet valve cap (12DB) when in a closed position. A faucet valve first washer (12DGA) is positioned around the faucet valve rod (12DE) adjacent to the faucet valve seat (12DC) and the faucet valve retainer (12DD). A faucet valve spring (12DF) is positioned around the faucet valve rod (12DE) adjacent to the faucet valve first washer (12DGA). A faucet valve second washer (12DGB) is positioned around the faucet valve rod (12DE) adjacent to the faucet valve spring (12DF). A faucet valve adjustment nut (12DH) is treadably engaged on the faucet valve rod (12DE) adjacent to the faucet valve second washer (12DGB). The faucet valve spring (12DF) functions to force the faucet valve seat (12DC) against the faucet valve cap (12DB). The faucet valve adjustment nut (12DH) functions to provide for adjustment of the force the faucet valve seat (12DC) exerts against the faucet valve cap (12DB).

The faucet valve (12D) further comprises a faucet valve lock nut (12DI) which is threadably engaged on the faucet valve rod (12DE) positioned adjacent to the faucet valve adjustment nut (12DH). The faucet valve lock nut (12DI), when tightened against the faucet valve adjustment nut (12DH), functions to prevent the faucet valve adjustment nut (12DH) from rotating away from a preselected position.

The liquid soap faucet dispenser (10) further comprises a soap dispenser (14) which comprises a soap dispenser adapter (14A) positioned at a top distal end. The soap dispenser adapter (14A) comprises a soap dispenser adapter soap adjuster (14AA) functioning to regulate an amount of liquid soap dispensed therefrom, soap dispenser soap tube (14B), having a soap dispenser soap tube outlet (14BA), is sealably connected to the soap dispenser adapter (14A) extending downwardly therefrom through an opening in the soap dispenser (14), a bottom end of a soap dispenser reservoir (14J) is sealably connected to the soap dispenser adapter (14A). The soap dispenser reservoir (14J) comprises a soap dispenser reservoir opening (14JA) at a top end thereof, a soap dispenser reservoir opening cap (14JAA) is removably sealably positioned on the soap dispenser reservoir opening (14JA). The soap dispenser reservoir opening cap (14JAA) comprises a soap dispenser air release valve (14JAAA). The soap dispenser air release valve (14JAAA) functions as a vacuum break. The soap dispenser (14) further comprises a soap dispenser connector (14C) extending perpendicularly therefrom rotatably mounted on the faucet valve sleeve (12DA). The faucet valve rod (12DE) extends longitudinally in a middle of the soap dispenser connector (14C) and terminates in a soap dispenser end sleeve (14H) securely mounted to an inside wall of the soap dispenser (14). The soap dispenser connector (14C) further comprises a slanted soap dispenser connector slot (14CA) therein, a soap dispenser connector pin (14D) is securely attached to the faucet valve sleeve (12DA) within the soap dispenser connector slot (14CA), a soap dispenser washer (14G) is positioned around the faucet valve rod (12DE) adjacent to the soap dispenser end sleeve (14H), a soap dispenser lock nut (14E) is threadbly mounted on the faucet valve rod (12DE) adjacent to the soap dispenser lock nut (14E). A soap dispenser adjustment nut (14F) is threadbly positioned on the faucet valve rod (12DE) adjacent to the soap dispenser lock nut (14E). The soap dispenser adjustment nut (14F) functions when tightened against the soap dispenser lock nut (14E) to prevent the soap dispenser lock nut (14E) from rotating away from a preselected position.

The soap dispenser (14) further comprises a soap dispenser outlet (14I) positioned on a side thereof When a user positions the soap dispenser (14) in a horizontal position, the faucet valve spring (12DF) compresses which causes the faucet valve cap (12DB) to disengage from the faucet valve seat (12DC) allowing water to flow from the faucet through the faucet body (12) and the soap dispenser (14) exiting through the soap dispenser outlet (14I). When the user positions the soap dispenser (14) in a vertical position, the faucet valve spring (12DF) decompresses causing the faucet valve cap (12DB) move toward and engage the faucet valve seat (12DC) which stops the flow of water and allows liquid soap to flow from the soap dispenser reservoir (14J) through the soap dispenser soap tube (14B) exiting from the soap dispenser soap tube outlet (14BA).

It will be understood that each of the elements described above, or two or more together, may also find an useful application in other types of constructions differing from the type described above.

While the invention has been illustrated and described as embodied in a liquid soap faucet dispenser, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A liquid soap faucet dispenser (10) comprising:

A) a faucet body (12) which comprises a faucet adapter (12A) positioned at a top distal end functioning to connect to a standard sink faucet, the faucet body (12) further comprises a faucet water pressure reducer (12B) sealably connected to the faucet adapter (12A) extending downwardly therefrom within the faucet body (12), the faucet water pressure reducer (12B) comprises at least one opening therein, the faucet body (12) further comprises a faucet connector (12C) extending at a perpendicular angle outwardly therefrom, the faucet body (12) further comprises a faucet valve (12D) positioned within a faucet valve sleeve (12DA) within the the faucet connector (12C), the faucet valve (12D) comprises a faucet valve rod (12DE) longitudinally disposed in a central position within the faucet valve sleeve (12DA), a faucet valve cap (12DB) is securely affixed to a first distal end of the faucet valve rod (12DE), a faucet valve seat (12DC) and a faucet valve retainer (12DD) is securely circumferentially positioned within the faucet valve sleeve (12DA), the faucet valve seat (12DC) and the faucet valve retainer (12DD) sealably engages the faucet valve cap (12DB) when in a closed position, a faucet valve first washer (12DGA) is positioned around the faucet valve rod (12DE) adjacent to the faucet valve seat (12DC) and the faucet valve retainer (12DD), a faucet valve spring (12DF) is positioned around the faucet valve rod (12DE) adjacent to the faucet valve first washer (12DGA), a faucet valve second washer (12DGB) is positioned around the faucet valve rod (12DE) adjacent to the faucet valve spring (12DF), a faucet valve adjustment nut (12DH) is treadably engaged on the faucet valve rod (12DE) adjacent to the faucet valve second washer (12DGB); and B) a soap dispenser (14) which comprises a soap dispenser adapter (14A) positioned at a top distal end, the soap dispenser adapter (14A) comprises a soap dispenser adapter soap adjuster (14AA) functioning to regulate an amount of liquid soap dispensed therefrom, soap dispenser soap tube (14B), having a soap dispenser soap tube outlet (14BA), is sealably connected to the soap dispenser adapter (14A) extending downwardly therefrom through an opening in the soap dispenser (14), a bottom end of a soap dispenser reservoir (14J) is sealably connected to the soap dispenser adapter (14A), the soap dispenser reservoir (14J) comprises a soap dispenser reservoir opening (14JA) at a top end thereof, a soap dispenser reservoir opening cap (14JAA) is removably sealably positioned on the soap dispenser reservoir opening (14JA), the soap dispenser reservoir opening cap (14JAA) comprises a soap dispenser air release valve (14JAAA), the soap dispenser air release valve (14JAAA) functions as a vacuum break, the soap dispenser (14) further comprises a soap dispenser connector (14C) extending perpendicularly therefrom rotatably mounted on the faucet valve sleeve (12DA), the faucet valve rod (12DE) extends longitudinally in a middle of the soap dispenser connector (14C) and terminates in a soap dispenser end sleeve (14H) securely mounted to an inside wall of the soap dispenser (14), the soap dispenser connector (14C) further comprises a slanted soap dispenser connector slot (14CA) therein, a soap dispenser connector pin (14D) is securely attached to the faucet valve sleeve (12DA) within the soap dispenser connector slot (14CA), a soap dispenser washer (14G) is positioned around the faucet valve rod (12DE) adjacent to the soap dispenser end sleeve (14H), a soap dispenser lock nut (14E) is threadably mounted on the faucet valve rod (12DE) adjacent to the soap dispenser lock nut (14E), the soap dispenser (14) further comprises a soap dispenser outlet (14I) positioned on a side thereof, when a user positions the soap dispenser (14) in a horizontal position, the faucet valve spring (12DF) compresses disengaging the faucet valve cap (12DB) from the faucet valve seat (12DC) allowing water to flow from the faucet through the faucet body (12) and the soap dispenser (14) exiting through the soap dispenser outlet (14I), when the user positions the soap dispenser (14) in a vertical position, the faucet valve spring (12DF) decompresses engaging the faucet valve cap (12DB) into the faucet valve seat (12DC) allowing liquid soap to flow from the soap dispenser reservoir (14J) through the soap dispenser soap tube (14B) exiting from the soap dispenser soap tube outlet (14BA).

2. The liquid soap faucet dispenser (10) as described in claim 1, wherein the faucet water pressure reducer (12B) further comprises at least one faucet water pressure reducer side opening (12BA) therein.

3. The liquid soap faucet dispenser (10) as described in claim 1, wherein the faucet water pressure reducer (12B) further comprises at least one faucet water pressure reducer bottom opening (12BB) therein.

4. The liquid soap faucet dispenser (10) as described in claim 1, wherein the faucet valve (12D) further comprises a faucet valve lock nut (12DI) threadably engaged on the faucet valve rod (12DE) positioned adjacent to the faucet valve adjustment nut (12DH).

5. The liquid soap faucet dispenser (10) as described in claim 1, wherein the faucet valve (12D) further comprises a faucet valve O-ring (12DJ) circumferentially positioned around the faucet valve sleeve (12DA) between the faucet connector (12C) and the soap dispenser connector (14C).

6. The liquid soap faucet dispenser (10) as described in claim 1 further comprises a soap dispenser adjustment nut (14F) threadably positioned on the faucet valve rod (12DE) adjacent to the soap dispenser lock nut (14E).

* * * * *